United States Patent [19]

Welch

[11] 4,314,707

[45] Feb. 9, 1982

[54] TOE GUARD FOR ROLLER SKATES

[76] Inventor: Don Welch, P.O. Box 337, Vail, Colo. 81657

[21] Appl. No.: 124,427

[22] Filed: Feb. 25, 1980

[51] Int. Cl.[3] ..... A63C 17/26

[52] U.S. Cl. ..... 280/11.2; 280/811

[58] Field of Search ..... 280/11.19, 11.2, 811, 280/11.21, 11.22, 11.27, 11.26

[56] References Cited

U.S. PATENT DOCUMENTS

| | | | |
|---|---|---|---|
| 1,351,509 | 8/1920 | Ess | 280/811 |
| 2,037,964 | 4/1936 | Chochkoff | 280/811 X |
| 4,094,525 | 6/1978 | Davis | 280/11.2 |
| 4,201,395 | 5/1980 | Matejec et al. | 280/811 |
| 4,240,132 | 12/1980 | Wickman | 280/11.2 X |

*Primary Examiner*—Robert R. Song
*Assistant Examiner*—Michael Mar
*Attorney, Agent, or Firm*—Richard D. Law; Dennis K. Shelton

[57] ABSTRACT

An abrasion resistant covering for the toe portion of the shoe of a shoe-type roller skate, secured to the skate toe stop, with non-turning assembly, and securable to the laces of the shoe.

9 Claims, 10 Drawing Figures

TOE GUARD FOR ROLLER SKATES

This invention relates to replaceable scuff guards for the toes of shoe type roller skates, having a rubber toe stop structure forward of the front roller skate wheels.

PRIOR ART

Roller skating has, of recent times, greatly increased throughout the world. Skating has, heretofore, been a popular pastime in rinks constructed for the purpose. These rinks have smooth skating floors, as for example, wood, or smooth concrete and hard rubber wheels were the skates of choice. The revived interest in roller skating has extended to skating on streets, sidewalks, parking lots, etc. Such surfaces are rough and tend to be abrasive to any sliding body. The current roller skates generally use wheels with wide, relatively resilient polyurethane tires on metal hubs and axles, as opposed to metal wheels used for years. These plastic wheels resist the abrasion of the exterior surfaced areas, and being relatively soft are capable of negotiating the rough surfaces with little bounce, jar or chatter to the roller skates.

A larger majority of the skates sold in the current market are shoe skates, that is, the shoe portion is fixed to the skate portion. Such shoes may be leather, canvas with rubber soles, etc. The toes of these generally do not resist the abrasive action of the exterior rough surface, since the toes of the shoes are frequently brought into contact with the skated-on-surface by the skater using the toe stops substantial damage frequently results to the toes of the shoes. Replacing the shoes of such shoe skates is expensive, and mostly accomplished in a shop.

The prior art is replete with various patents concerning skates. A toe stop unit is shown in U.S. Pat. No. 3,180,651 to Ware on Apr. 27, 1965. This toe stop is the forerunner of most toe stops presently in use. A toe stop is behind the toe, it is easily seen how the toe of the shoe attached to the skate (whether fixed or removable) is readily scraped on the rough surfaces. One early attempt to prevent toe scuffing is shown in U.S. Pat. No. 1,351,509 to Ess of Aug. 31, 1920. This unit is a metal toe piece which attaches to a skate and is held in place by the sole clamps of the skate. This apparently was before the time of toe stops.

A rubber guard is held by rivets to the plate of a skate in U.S. Pat. No. 2,308,251, so that the guard protects the sole of a shoe temporarily fastened to the skate.

A metal guard is secured to the plate of a roller skate in U.S. Pat. No. 3,104,887. The guard extends beyond the plate of the roller skate and does not contact the shoe which is clamped onto the skate base plate.

A stream-lined skate is shown in U.S. Pat. No. 2,245,769 to Flamm on June 17, 1941. This unit has a streamlined housing into which a shoe is placed for clamping to the skate plate. The housing extends back of the toe of the shoe and includes a skirt around the front wheels. The housing provides a stop. The user's shoe is positioned in the housing and clamped to the plate. The housing is affixed to the skate plate.

Toe protectors have been shown in the prior art, as for example, a metal, complete toe cover shown in U.S. Pat. No. 3,518,781 to De Vita on July 7, 1970. Such a protector covers the top of the shoe without regard to the shoe sole, as it is intended to protect the foot from dropped objects, oil etc.

A full covering for an ice skate is shown in U.S. Pat. No. 1,714,760 to Bloomberg on May 28, 1929. This, also, shows a cover for the full toe portion of an ice skate. These coverings are leather lined with insulating material or like for keeping one's feet warm.

A metal toe guard for ice skates is shown in U.S. Pat. No. 1,806,975 to Johnson et al on May 26, 1931, to protect the toes of the user from blows delivered by hockey sticks. A slightly modified toe guard is shown in U.S. Pat. No. 1,832,866 to the same inventor on Nov. 24, 1931. This metal toe guard is, also, fastened to the skate plate and laced by the shoe laces.

An attachment for shoeless roller skates is shown in U.S. Pat. No. 2,037,964 of Apr. 21, 1936 to Chochkoff. This shows a metal toe cap having a strap holder (strap from the heel of the skate). The toe cap is rivetted to the skate plate, and the shoe is clamped to skate plate. The top of the toe cap includes means for holding the skate heel strap from slipping up on the ankle of the user.

THE PRESENT INVENTION

The present invention provides a flexible, resilient toe guard, which is readily attached to or detached from a skate toe-stop and to the laces of the skate's attached shoe. This guard is formed of abrasion resistant synthetic plastic, such a polyurethane, etc., and is provided with means to prevent the toe protector from being turned away from the toe, as by contact between the toe protector and the skating surface during a stop or by dragging a toe. The toe protector or guard is formed as a replaceable member, which is easy and fast to mount on a skate or replace a damaged protector.

OBJECTS AND ADVANTAGES OF THE INVENTION

Included among the objects and advantages of the invention is a replaceable toe protector for the toe of a shoe skate.

Another object of the invention is to provide a replaceable toe protector for the shoe of a roller skate having means to prevent turning of the protector off the toe under the stress of hard usage.

Yet another object of the invention is to provide a replaceable toe protector that attaches to a skate by the toe-stop bolt mounting means, and, also, provides additional stopping means for a skater.

A still further object of the invention is to provide a elongated toe protector for roller skates that is secured by the single bolt of a toe stop mount at one end and the shoe laces on the other end.

An additional object of the invention is to provide a toe protector for the toe of a shoe mounted on roller skates which is inexpensive but highly effective in preventing damage to the shoe, and which is easily and quickly installed on the skate, including both new and existing skates.

These and other objects of the invention may be ascertained by reference to the following description and appended drawings.

GENERAL DESCRIPTION OF THE DRAWINGS

DETAILED DESCRIPTION OF THE DRAWINGS

Figure 1:
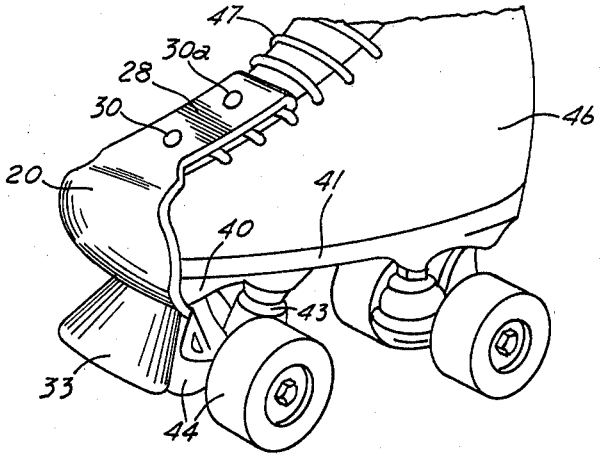
FIG. 1 is a perspective view of a roller shoe-skate utilizing the toe protector according to the invention.

One form of the invention is illustrated in FIGS. 2 to 5, wherein an elongated strap-like member 10 includes a rounded end 12 having bore 14 centered in the round portion. A plurality of upstanding, round ended projections 16 are spaced around the bore and equispaced around and from it. Joining the rounded end is a short area 18 with parallel sides and joined to it is an enlarged area toe cover area 20 with rounded edges 21 and 22. An area 24 of about the wide of area 18 connects to and extends from the enlarged toe cover area. A necked-down connecting area 26 connects to a strap portion 28. Snap fastener halves 29–30 and **29*a*–30*a*** are secured through the strap in position to be snapped together to form a loop, explained below.

The toe protector is arranged to be connected between a skate plate and a rubber toe stop 33, in the general shape of a trunicated circular cone, with small area 34 and large area 35. The rubber toe stop includes a central stepped bore 36 with a metal insert 37 in the stepped bore. The toe stop is secured to a roller skate toe stop support by means of a bolt (not shown) passing through the bore 36 and resting on the metal insert 37. The toe stop support holds the toe stop at an angle forwardly of the wheels. The toe stop includes a series of bores 38 of the same configuration as the projections 16, and the bores have a diameter and depth to frictionally secure the projections of the toe protector therein. The area 12 is mounted between the toe stop and the stop support on the skate plate.

With the projections of toe protector mounted in the holes in the toe stop, the toe stop is secured to the skate plate by a single bolt and pulled tight. The bolt passes through bore 36 and hole 14, with the toe protector extending straight forward of the skate. As shown in FIG. 1, the toe stop 33 is fastened to a support 40 mounted on the forward end of a skate plate 41, which, also, supports wheel stanchion 43 holding the skates, front wheels 44. A lace shoe 46, with laces 47, is factory fastened to the skate plate by well known means. The toe protector is pulled back over the toe of the shoe so that the enlarged area 20 covers the toe of the shoe. The strap is folled back on itself, and the snap fasteners 29 and 30 are engaged to form a loop. In some instances, a double set of snap fasteners may be desirable, and snap fastener halves **29*a* and 30*a* may be secured to the strap portion along with snap fastener halves 29 and 30. The laces 47** are passed through the loop or loops of the strap to maintain the toe protector in place. The protector may be pulled tight by its placement in the laces.

The toe protector is preferably a molded, one piece, flexible, resilient polymer. In one form, it is made of polyurethane of a relatively low durometer so as to quite flexible and easy to install on the skate. The thickness is sufficient to provide strength for the stresses to which it is subjected by skaters, usually about $\frac{1}{8}$ to $\frac{1}{4}$ inch. Also, it is desirable to provide an extra thickness "x" in the toe covering part 20, shown in FIG. 2. This provides extra protection and a longer life of the toe protector.

Figure 2:
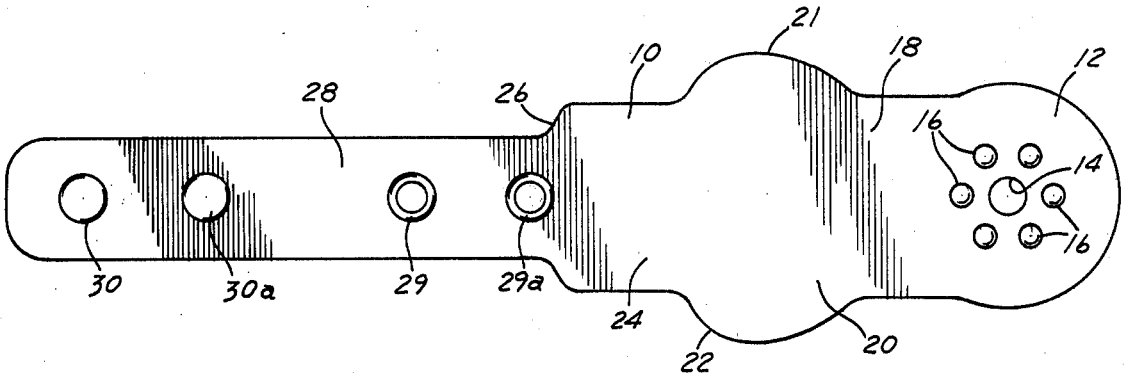
FIG. 2 is a plan view of one form of a flexible, resilient toe protector according to the invention.
Figure 3:
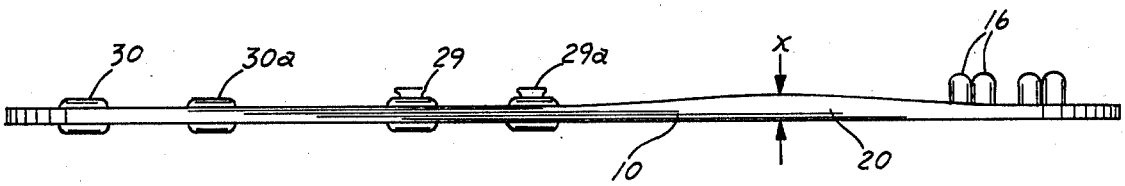
FIG. 3 is a side elevation of the device of FIG. 2.
Figure 4:
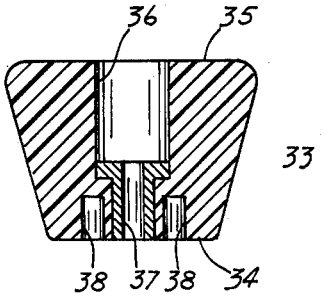
FIG. 4 is side, cross-sectional view of a modified toe stop for a roller skate including holding means for a toe protector.
Figure 5:
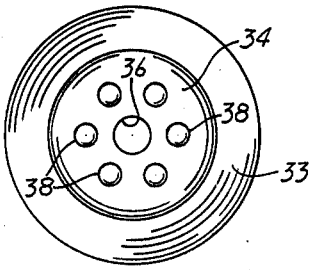
FIG. 5 is a bottom plan view thereof.
Figure 6:
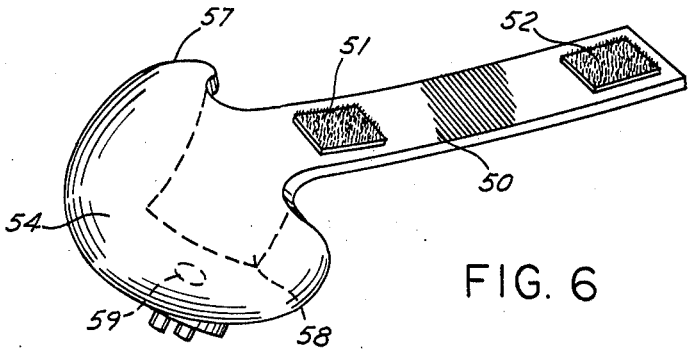
FIG. 6 is a perspective of a modified toe protector for roller skate shoes including modified attaching means.

In the modified toe protector of FIG. 6, a strap 50 is provided with a two part plastic hook and mat fastener 51 and 52, (such as Velcro-a trademark). The unit includes a wraparound cup-shaped toe area 54 and includes wings 56 and 57 which extend around to the side of the shoe adjacent the toe area. A toe stop connector portion 58 extends from the toe cover to a position where it is attachable to a toe stop and support as in FIGS. 1–5. The unit is connected to the toe stop support by a bolt (not shown) through bore 59, as in the case of the previous unit. The toe protector is preferably molded to fit a skate shoe. The unit of FIGS. 2–5, however, may be made planar, as generally shown in FIG. 2.

Figure 7:
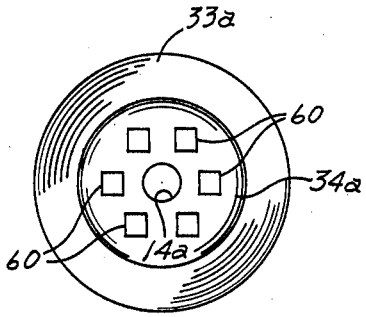
FIG. 7 is a bottom plan view of modified form of toe stop having holding means for a toe protector.
Figure 8:
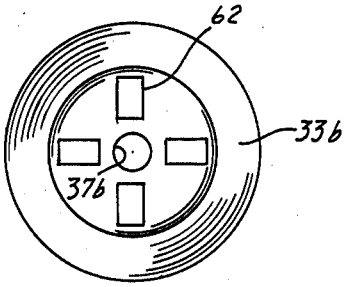
FIG. 8 is a bottom plan view further modified toe stop with holding means.
Figure 9:
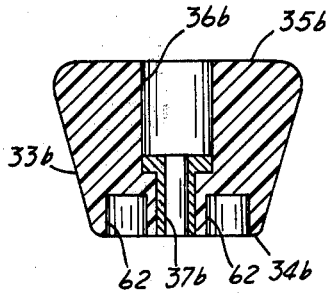
FIG. 9 is a cross-section thereof.

The projections 16 of the unit of FIGS. 2–5, are arranged to prevent the toe protector from turning about the holding bolt. The unit is shown with 6 projections, but the number may be changed as desired and necessary. Also, the configuration of the projections may be changed as desired. As shown in FIG. 7, the projections may be made square. The square projections, of a square cross section, are arranged to frictionally fit holes 60 in the surface 34 and in toe stop **33*a*. The projections (not shown) are made of a height and configuration to fit the holes in the manner of projections 16. When the toe stop is pulled tight against the support by a bolt through bore 14*a*, the unit is tightly held in place. Rectangular projections may be used, as shown by 4 holes in FIGS. 8–9, where a toe stop 33*b* has 4 rectangular holes 62 spaced around a bore hole 36*b*. The holes 62 are a depth into the toe stop 33*b*** so as to securely hold projections forced into them.

Figure 10:
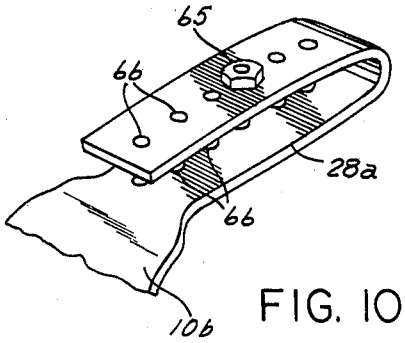
FIG. 10 is a perspective view of a modified toe protector fastening means for the laces of a shoe.

The strap may be of a desired length to loop over one or more laces. Also, different fastener means may be provided, such as a bolt and nut 65 shown in FIG. 10, fastening a strap **28*a* which is a part of the toe protector. The strap has a series of holes 66** which extend along the length of strap. Of course, one or more fastened, and the shoe laces passed through the loop, or it may be passed under and over the laces and then fastened into a loop.

What is claimed is:

1. A replaceable toe protector for use in connection with a shoe-type roller skate having a lace closure and a toe stop fixed to the skate adjacent to the toe of the shoe, comprising:

an elongated flexible body having a strap portion at a first end of the body, a skate attaching portion at a second end of the body, and a toe covering portion interconnecting the strap portion and the skate attaching portion, the strap portion being adapted to be reversibly folded back on itself to form a loop for encasing at least a portion of the lace closure of the shoe-type roller skate and including means for fastening the folded back strap portion into the loop, and the skate attaching portion including a bolt hole adapted to receive a bolt of the toe stop and further including a series of depending position holding elements adapted to cooperate with corresponding bores in the toe stop to prevent turning of the toe covering portion away from its toe covering position when the skate attaching portion is attached between the skate and the toe stop by the bolt and when the strap portion is attached to the skate by the lace closure.

2. A replaceable toe protector for shoe-type roller skates according to claim 1 wherein said plastic body is a polyurethane.

3. A replaceable toe protector for shoe-type roller skates according to claim 1 wherein said means for fastening said strap portion includes at least one snap fastener assembly for forming a loop of said strap.

4. A replaceable toe protector for shoe-type roller skates according to claim 1 wherein said means for fastening said strap portion includes a hook and mat assembly for forming a loop.

5. A replaceable toe protector for shoe-type roller skates according to claim 1 wherein said means for fastening said strap portion includes a series of holes through which said fastening means may be passed to secure a loop.

6. A replaceable toe protector for shoe-type roller skates according to claim 1 wherein said toe covering area includes a molded cup with side wings to essentially cover the toe of the shoe.

7. A replaceable toe protector for shoe-type roller skates according to claim 1 wherein said position holding elements are a series of integral, upright prongs fitting in cooperative holes in the toe stop.

8. A replaceable toe protector for shoe-type roller skates according to claim 7 wherein said prongs are circular with a rounded end.

9. A replaceable toe protector for shoe-type roller skates according to claim 7 wherein said prongs are rectangular in cross-section.

* * * * *